United States Patent [19]

Kurokawa et al.

[11] 4,054,112

[45] Oct. 18, 1977

[54] FUEL INJECTION GOVERNOR

[75] Inventors: Fuminori Kurokawa, Matsuyama; Yasuhide Suzuki, Okabe, both of Japan

[73] Assignee: Diesel Kiki Co., Ltd., Tokyo, Japan

[21] Appl. No.: 600,239

[22] Filed: July 30, 1975

[30] Foreign Application Priority Data

Aug. 1, 1974 Japan ..... 49-91101[U]

[51] Int. Cl.[2] ..... F02D 1/04

[52] U.S. Cl. ..... 123/140 MP; 123/140 MC

[58] Field of Search ..... 123/140 R, 140 FG, 140 MP, 123/140 MC, 139 ST, 179 L

[56] References Cited

U.S. PATENT DOCUMENTS

| | | | |
|---|---|---|---|
| 2,717,587 | 9/1955 | Links et al. | 123/140 R |
| 3,103,822 | 9/1963 | Miracki | 123/140 R |
| 3,572,304 | 3/1971 | Becker et al. | 123/140 MP |
| 3,577,968 | 5/1971 | Staudt et al. | 123/140 R |
| 3,818,883 | 6/1974 | Glassey | 123/140 MP X |
| 3,884,205 | 5/1975 | Staudt et al. | 123/140 R |
| 3,938,488 | 2/1976 | Aoki | 123/140 R |

*Primary Examiner*—Carroll B. Dority, Jr.
*Assistant Examiner*—Tony M. Argenbright
*Attorney, Agent, or Firm*—Frank J. Jordan

[57] ABSTRACT

A floating lever has an intermediate fulcrum and is pivotally connected at one end to a fuel control rod. The other end of the floating lever carries a pin. A second lever is pivotally connected at an intermediate point to a manual fuel control member and at one end to flyweights. The other end of the second lever engages with one side of the pin. An arm is pivotally carried by the second lever and is urged by a spring to engage with the opposite side of the pin. A boost compensator diaphragm assembly includes an adjustable linkage with which the pin is abuttingly engageable. The spring is adapted to yield when the flyweight rotational speed decreases and the flyweights rotate the second lever so that the pin abuts against the linkage so that the positions of the pin, floating lever and thereby the control lever in the fuel increasing direction are limited by the diaphragm assembly.

10 Claims, 2 Drawing Figures

FUEL INJECTION GOVERNOR

The present invention relates to a fuel injection pump governor assembly for an engine such as a compression ignition engine.

Fuel injection pump governor assemblies are well known in the art which include a flyweight assembly and a boost compensator diaphragm assembly to determine the position of a fuel injection control rod. The boost compensator diaphragm assembly is connected to a supercharger such as a turbocharger and serves to limit the maximum fuel injection volume as a function of the boost pressure. The maximum amount of fuel which can be injected into the engine without producing smoky exhaust gases depends on the amount of air available in the cylinders for combustion which is determined by the boost pressure.

Two types of such governors are known in the art. In a first type the flyweight assembly, boost compensator and control rod are provided as an integral unit. The disadvantages of this type are that the configuration is complicated and it is difficult or impossible to make adjustments between the boost compensator and the rest of the governor.

In the second type of governor the boost compensator is provided on the injection timing unit side of the governor and engages with the control rod at an end opposite to that which engages with the flyweight assembly. The disadvantage of this type is that it is not readily adaptable to a flange mounted governor.

It is therefore an object of the present invention to provide a governor including a flyweight assembly, boost compensator and fuel control rod in which the boost compensator is provided separately and engages with the flyweight assembly and control rod.

It is another object of the present invention to provide a governor including a boost compensator which has means for making adjustments between the boost compensator and the rest of the governor.

Figure 1:
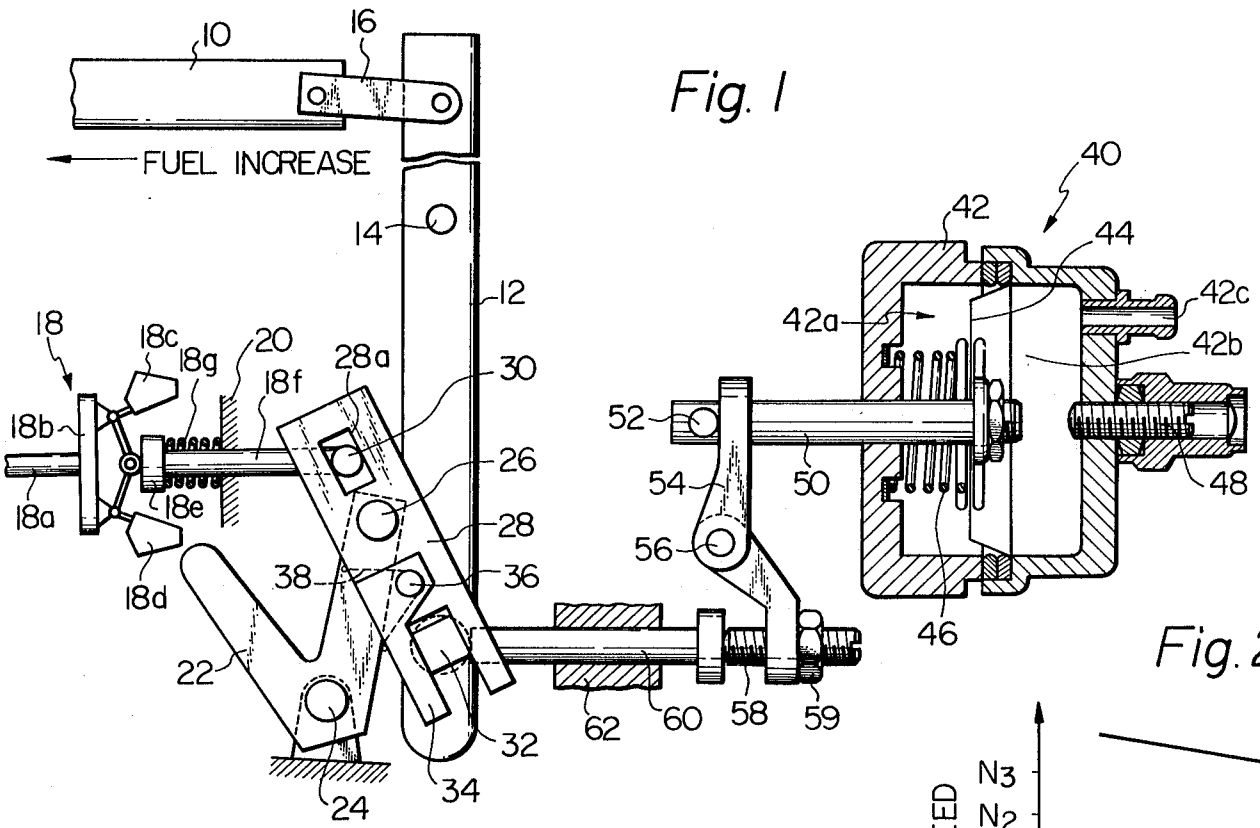
Figure 2:
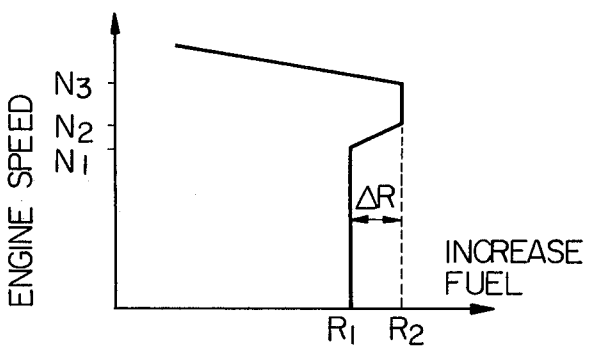

The above and other objects, features and advantages of the present invention will become clear from the following detailed description taken with the accompanying drawings, in which:

FIG. 1 is a schematic view, partly in section, of a governor according to the present invention; and FIG. 2 is a graph illustrating the operation of the governor shown in FIG. 1.

Referring now to FIG. 1, the governor comprises a fuel control rod 10 which is adapted to be connected to a fuel injection pump for a compression ignition (Diesel) engine (not shown) to control the volume of fuel injected by the pump into the engine. A floating lever 12 has an intermediate fixed pivot pin 14 and is pivotally connected at its upper end through a link 16 to the control rod 10. A flyweight assembly 18 includes an engine driven shaft **18*a* which carries a plate 18*b*. Flyweights 18*c* and 18*d* are pivotally connected to the plate 18*b* and engage with a control sleeve 18*e*. A rod 18*f* is connected to the sleeve 18*e*. A compression governor spring 18*g* is disposed between a fixed member 20 and the sleeve 18*e* to urge the sleeve 18*e* and rod 18*f* leftward as viewed in FIG. 1. In operation, as the rotational speed of the shaft 18*a* increases, the flyweights 18*c* and 18*d* are flung outward by centrifugal force and urge the sleeve 18*e* and rod 18*f* righward against the force of the spring 18*g***.

A manual control lever 22 has an intermediate fulcrum 24 and carries a pin 26 at its upper end. A lever 28 is pivotally connected to the lever 22 by means of the pin 26. The rod **18*f* carries at its end a pin 30 which slidingly engages in a rectangular slot 28*a* formed in the upper end of the lever 28**.

The floating lever 12 rotatably carries at its bottom end a pin 32. The lower end portion of the lever 28 abuttingly engages with the upper right side of the pin 32. An arm 34 is pivotally connected to the lever 28 by a pin 36. A torsion spring 38 engaging with the lever 28 and arm 34 urges the arm 34 counterclockwise about the pin 36 so that the end portion of the arm 34 engages with the lower left side of the pin 32 which is opposite to the side of the pin 32 with which the lever 28 engages.

A pressure sensitive means includes a diaphragm assembly 40 which comprises a housing 42 which supports therein a flexible diaphragm 44 which divides the interior of the housing 42 into a spring chamber **42*a* and a pressure chamber 42*b*. The housing 42 is formed with a port 42*c* opening into the pressure chamber 42*b* which leads to an engine supercharger which is not part of the invention and is not shown. The right side of the diaphragm 44 is thereby exposed to the boost or supercharged pressure of the air being forced into the engine cylinders by the supercharger. A compression spring 46 is disposed in the spring chamber 42*a* and urges the diaphragm 44 rightward against the force exerted on the diaphragm 44 by the boost or supercharged air in the pressure chamber 42*b*. When the boost pressure is below a predetermined value, the spring 46 urges the diaphragm 44 into engagement with an adjustable stop screw 48 provided at the right side of the housing 42**.

A linkage (no numeral) is provided to connect the diaphragm 44 to the floating lever 12, which comprises a rod 50 connected to the diaphragm 44 and movable left and right thereby. The rod 50 carries at its end a pin 52. A lever or link 54 is rotatable about a fixed pin 56, and the left side of the upper end of the link 54 engages with the pin 52. A rod or screw 58 is provided at the lower end of the link 54 and screwably extends therethrough. A locknut 59 holds the screw 58 at a desired position. A rod 60 is axially slidable retained by a fixed member 62 so as to be slidable left end right. The left end of the rod 60 is abuttingly engagable with the pin 32 and the right end of the rod 60 is abuttingly engagable with the left end of the screw 58.

The operation of the governor will now be described with reference also being made to FIG. 2.

The engine operator rotates the manual control lever 22 clockwise to demand maximum fuel injection volume for starting the engine. This causes the lever 28 to pivot counterclockwise about the pin 26 since the pin 30 is engaged in the slot **28*a*. The spring 38 urges the arm 34 counterclockwise about the pin 36. The engagement of the arm 34 with the pin 32 causes the floating lever 12 to rotate counterclockwise about the pin 14 and move the fuel control rod 10 leftward to a maximum starting fuel injection position designated as R1 in FIG. 2. The position R1 is determined by the abutment of the pin 32 against the left end of the rod 60. When this occurs, the movement of the pin 32, floating lever 12 and fuel control rod 10 is stopped. Further clockwise rotation of the control member 22 will cause the lever 28 to rotate further counterclockwise, but the spring 38 will yield and the lever 28 will disengage from the pin 32. The arm 34 will, however, be held in engagement with the pin 32** by the spring 38. The strength of the spring 38 must necessarily be less than that of the spring 46.

With the engine speed close to zero, the flyweights 18c and 18d will be retracted and the rod 18f and pin 30 will be in their leftmost positions. As the engine is ignited, the speed of the engine shaft and thereby the shaft 18a will increase to a value N1 at which the boost pressure in the pressure chamber 42b of the diaphragm assembly 42 is sufficient to overcome the force of the spring 46. The diaphragm 44, rod 50 and pin 52 will be moved leftward thereby in an engine speed region between the speed N1 and a speed N2. It will be noted that the strength of the spring 18g is such that the rod 18f and pin 30 will not move rightward against the force thereof until the engine speed reaches a higher value than N2 at the particular position of the control member 22.

As the rod 50 and pin 52 move leftward, the spring 38 will urge the pin 32 rightward so that the floating lever 12 rotates counterclockwise and moves the control rod 10 lefward to a position R2 which provides higher fuel injection voluem. It will be understood that as the engine speed increases, the boost pressure provided by the supercharger will also increase so that more fuel can be burned without producing smoky exhaust gases. The rightward movement of the pin 32 will move the rod 60 rightward and cause the link 54 to pivot counterclockwise until the left side of the upper end of the link 54 abuts against the pin 52. Since the spring 38 is weaker than the spring 46, the position of the rod 50 and pin 52 will be determined only by the boost pressure. The spring 38 will move the pin 32 rightward so that the pin 32 is maintained in engagement with the left end of the rod 60, the right end of the rod 60 is maintained in engagement with the left end of the screw 58 and the link 54 is maintained in engagement with the pin 52. In this manner, the position of the control rod 10 is determined by the position of the diaphragm 44 and thereby the boost pressure.

As the engine speed and thereby the boost pressure further increase, the diaphragm 44 will be moved leftward to an extent that the spring 46 will be compressed to its solid length. This occurs when the control rod 10 has reached the position R2 and the engine speed is N2.

Further increase of the engine speed will cause the rod 18f and pin 30 to move rightward against the force of the governor spring 18g. The engagement of the pin 30 in the slot 28a of the lever 28 will cause the lever 28 to rotate clockwise about the pin 26. When the engine speed reaches a value N3, the lever 28 engages with the pin 32. As the engine speed rises higher than N3, the clockwise rotation of the lever 28 will move the pin 32 leftward and cause the floating lever 12 to rotate clockwise. This will move the control rod 10 rightward to reduce the fuel injection volume. Under these conditions, both the lever 28 and arm 34 engage with the pin 32 and move as a unit since the arm 34 is urged into engagement with the pin 32 by the spring 38. Since the spring 46 is compressed to its solid length and further leftward movement of the pin 52 is not possible, the pin 32 will move away from the rod 60 and a gap will be created therebetween. After the starting operation of the engine is completed, the engine speed is controlled by the manual control member 22 and flyweight assembly 18 in a conventional manner. The control rod 10 position will be limited to the position R2 when the engine speed is above N2 and to the position R1 when the engine speed is below N1 by the diaphragm assembly 40 and linkage as described above. For engine speeds between N1 and N2 the control rod 10 position will be limited to a value between R1 and R2 which is dependent on the position of the diaphragm 44.

In accordance with the present invention the stop screw 48 is movable left and right to determine the stroke $\Delta R = R2 - R1$ of the control rod 10 which is controlled by the diaphragm assembly 40. The stroke $\Delta R$ is equal to the displacement of the diaphragm 44 between abutment with the stop screw 48 and the position at which the spring 46 is compressed to its solid length multiplied by the mechanical advantage of the link 54 in combination with the floating lever 12. The screw 58 is adjustable to set the position R1 of the fuel control rod 10 at which the pin 32 abuts against the left end of the rod 60 at engine speeds below N1.

It will be understood that various modifications are possible within the scope of the present invention. For example, the link 54 and rod 60 may be omitted and the rod 50 be made directly engagable with the pin 32. The rod 60 may be made to abut against the floating lever 12 itself rather than the pin 32. The spring 38 may be replaced by, for example, a tension or compression spring connected between the arm 34 and a fixed member, although not shown. Many other modifications will become apparent to those skilled in the art after receiving the teachings of the present disclosure.

What is claimed is:

1. In a fuel injection governor having flyweights, a pressure sensitive means and a fuel control rod, the combination therewith of:

a first lever being rotatable about a fixed point and pivotally connected to the control rod, the pressure sensitive means being abuttingly engageable with the first lever;

a pin carried by the first lever;

a second lever being rotatable about an intermediate point and pivotally connected at one end to the flyweights, the other end of the second lever abuttingly engaging with one side of the pin;

an arm pivotally connected to the second lever and engaging with a side of the pin opposite to the other end of the second lever; and biasing means yieldably urging the arm into engagement with the pin.

2. The governor of claim 1, in which the pressure sensitive means abuttingly engages with the pin.

3. The governor of claim 1, further comprising a manual fuel control member, the second lever being pivotally connected at the intermediate point to the manual fuel control member.

4. The governor of claim 1, in which the pressure sensitive means includes a diaphragm means and a linkage, the linkage engaging at one end with the diaphragm means and at its other end with the first lever.

5. The governor of claim 4, in which the linkage is provided with adjustment means.

6. The governor of claim 1, further comprising a linkage connecting the pressure sensitive means to the first lever, the linkage including a first rod connected to the pressure sensitive means, a pin carried by the first rod, a third lever rotatable about an intermediate point and engaging at one end with the pin of the first rod, an axially movable second rod engaging at one end with the first lever, the other end of the third lever engaging with the other end of the second rod.

7. The governor of claim 6, further comprising a third rod carried by the other end of the third lever and engaging with the other end of the second rod and means for adjustably varying the length of the third rod.

8. The governor of claim 1, in which the biasing means is a spring.

9. The governor of claim 8, in which the spring is connected at one end to the second lever and at the other end to the arm.

10. The governor of claim 9, in which the spring is a torsion spring.

* * * * *